US005096103A

United States Patent [19]

Baugh

[11] Patent Number: 5,096,103

[45] Date of Patent: Mar. 17, 1992

[54] REMOVABLE SNOWBOARD WAIST PACK

[76] Inventor: Randy Baugh, 1630 N. Main, #167, Walnut Creek, Calif. 94596

[21] Appl. No.: 639,596

[22] Filed: Jan. 9, 1991

[51] Int. Cl.[5] ..... A45C 15/00; A45F 3/00

[52] U.S. Cl. ..... 224/151; 224/224; 224/226; 224/229

[58] Field of Search ..... 224/151, 224, 226, 227, 224/901, 229, 236, 240; 280/87.042, 769; 441/74

[56] References Cited

U.S. PATENT DOCUMENTS 4,285,082 8/1981 Cox ..... 224/901

4,424,841 1/1984 Smith ..... 224/151 X 4,515,300 5/1985 Cohen ..... 224/151

4,955,835 9/1990 Hollingsworth ..... 441/74

OTHER PUBLICATIONS

"SkateSling" advertisement in SkateBoarder of Jan. 1978—vol. 4, #6.

*Primary Examiner*—Henry J. Recla

*Assistant Examiner*—David J. Walczak

[57] ABSTRACT

A pack for attachment to a snowboard by hook and loop fasteners and having front and top pouches and a carrying strap whereby the pack can be removed from the snowboard and worn about a person's waist.

2 Claims, 4 Drawing Sheets

REMOVABLE SNOWBOARD WAIST PACK

BACKGROUND OF THE INVENTION

1. Field of the Invention

The present invention relates to waist or hip packs which can be worn around the waist for carrying personal items and, more particularly, it relates to a dual purpose hip pack which can be secured to a snowboard by velcro fasteners whereby it can be transported on a snowboard while it is being ridden and then removed for carrying the rider's personal items around his waist when he is carrying the snowboard or has placed it in storage.

2. Description of the Prior Art

Hip, waist and butt packs have become popular for carrying small personal items in a pouch secured around a person's waist by a belt whereby the person's hands are free and the pack does not hang loosely from a shoulder whereby it might slip off. These packs are securely fastened around the wearer's waist, either in front, on the hip, or low on the wearer's back. They can withstand violent movement of the wearer's body and do not lose their position by being displaced or unhooked or falling down. Initially, the waist packs were worn by women around their waist on their rear, but more recently the packs have come into male use and acceptance with the advent of drug dealers wearing them around the front of their body for easy access, secrecy and safety. As a result of the male utilization in the counter culture, the packs have rapidly gained unisex acceptance and are wearable by males as well as females especially in individual sporting activities or at the beach. Both sexes have adapted to a more uniform wearing on the front of the body as opposed to the rear for safety against theft and also for comfort. However, the waist or hip packs have not been adaptable to mounting on other items, and particularly a flat surface, especially without the use of the waist strap. The present invention provides a means for carrying the waist pack on the snowboard as well as wearing it whereby it has a dual purpose utilization factor in that it can be attached to the snowboard and then removed for carrying the personal items on the rider's body when he or she is not riding the snowboard.

SUMMARY OF THE INVENTION

The present invention is a removable snowboard pack which includes a flat rear panel portion having a width equal to or less than the width of a snowboard for securing the pack thereto. The rear panel has a generally straight upper edge and a rounded bottom edge and sides. Loop engagement strips are provided at peripheral locations around the panel on the outside thereof for securement to mating hook engagement strips secured to the snowboard at pre-selected positions thereon for removably securing the back panel of the pack to a snowboard.

A front pocket panel is secured to the rear panel along the peripheral side and the bottom edges thereof and has a zippered opening therein and a straight upper edge of longer length than said rear panel upper edge. A pair of semicircular top panels are secured to the top edges of the rear and front panels with the flat edges of the semicircular panels being secured to the straight upper edge of the rear panel and the rounded edge of the lower of the two top panels being secured to the straight upper edge of the front panel. The rounded edge of the top panel is secured to the upper edge of the front panel with a zippered connection for at least a portion of the length thereof. A carrying strap is secured to the pack at the ends of the straight upper edge of the rear panel. The carrying strap includes a buckle disposed mid-length thereof whereby the strap is adjustable and can be detached into two separate free ends secured to the pack.

OBJECTS OF THE INVENTION

It is therefore an important object of the present invention to provide a removable snowboard pack which can be secured to a snowboard for carrying personal items.

It is another object of the present invention to provide a snowboard pack which can be removed from the snowboard and worn around the rider's waist when he is not riding the board and wants to carry his personal items on him apart from his board.

It is a further object of the present invention to provide a removable snowboard pack which can be secured to a snowboard by means of hook and loop engagement strips for easy attachment or detachment.

It is still another object of the present invention to provide a removable snowboard pack which has an adjustable waist band to allow the pack to be worn around a snowboard rider's waist.

And it is still a further object of the present invention to provide a removable snowboard pack which is a waist or hip pack and has a multiplicity of pockets for keeping personal items divided into preferred categories in separate pockets of the pack.

Other objects and advantages of the present invention will become apparent when the apparatus of the present invention is considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
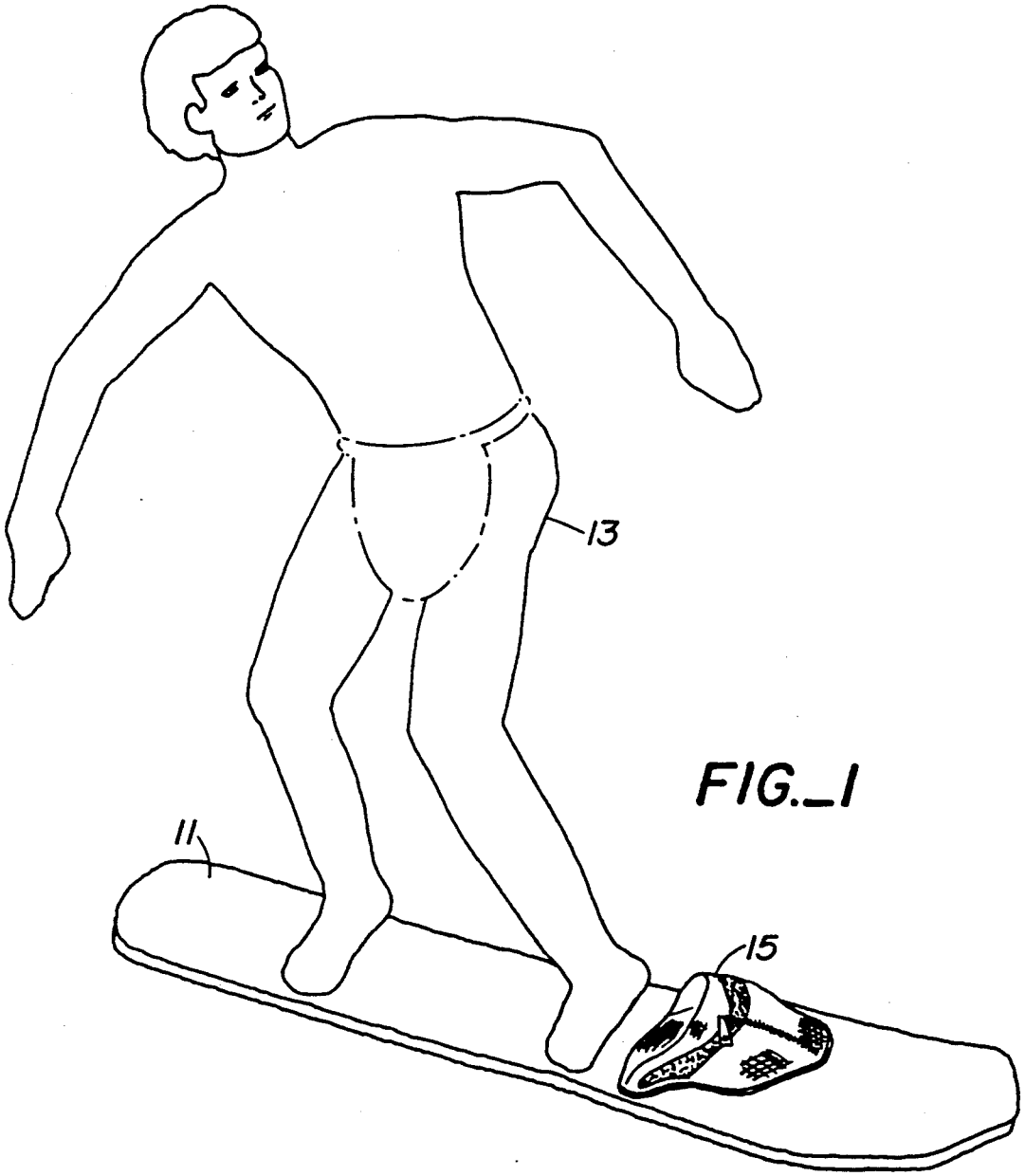
FIG. 1 is a perspective view of a snowboard having the removable pack of the present invention secured to the front end thereof.

FIG. 1 illustrates a snowboard 11 having a rider 13 standing thereon showing the removable snowboard waist pack 15 of the present invention secured to the front end of the snowboard. Prior to the present invention, various means have been utilized to attach transportable personal item carriers to various objects, but most have lacked the characteristic of being easily attached and detached to or from a specified base platform. Thus, the present invention could also be secured to a wall, a rigid backing, kayak, motorcycle, or other base platform.

The present invention can be utilized to carry particular items one might wish to have available when riding a snowboard or items one might wish to have before, between, and after sessions of activity riding a snowboard.

Figure 2:
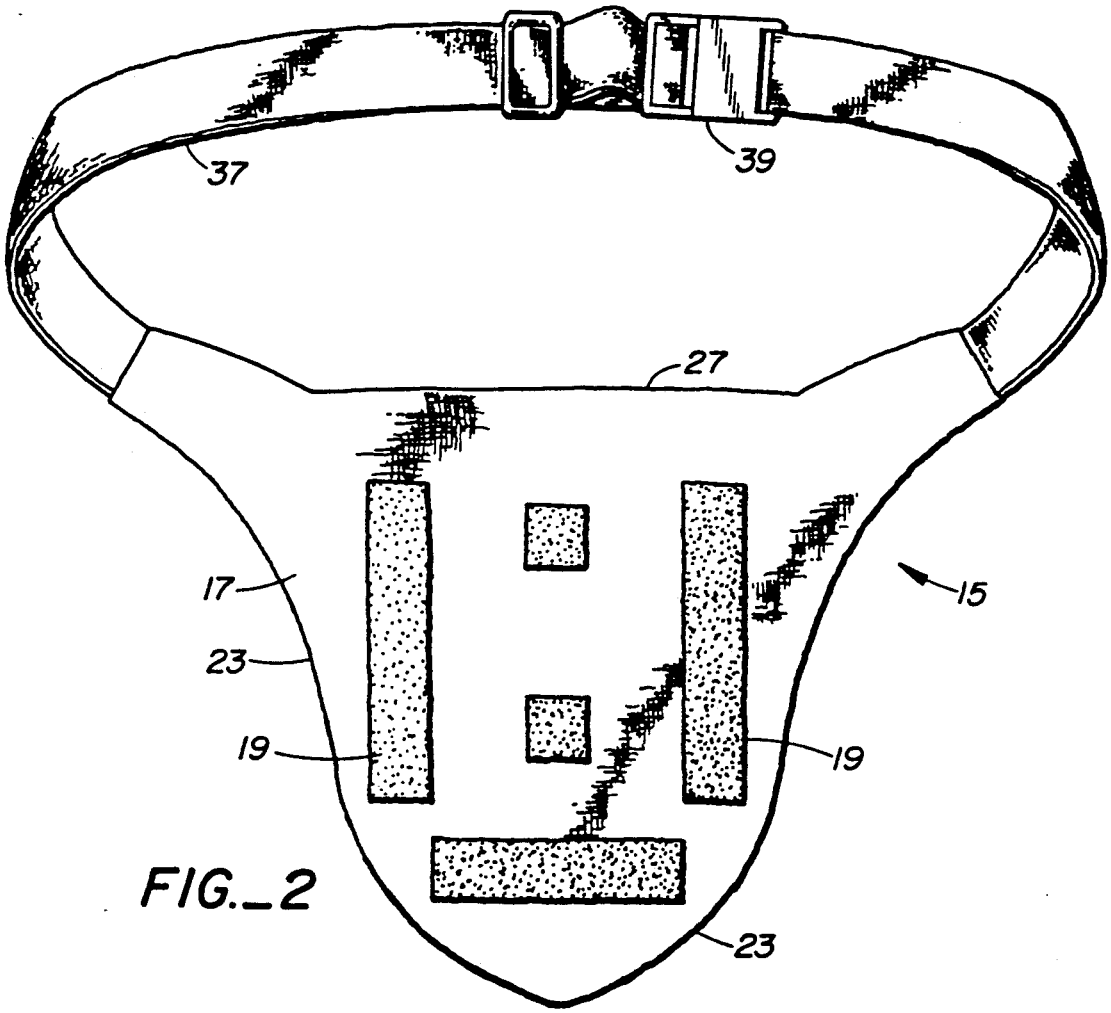
FIG. 2 is a rear perspective view of the snowboard pack of the present invention.
Figure 4:
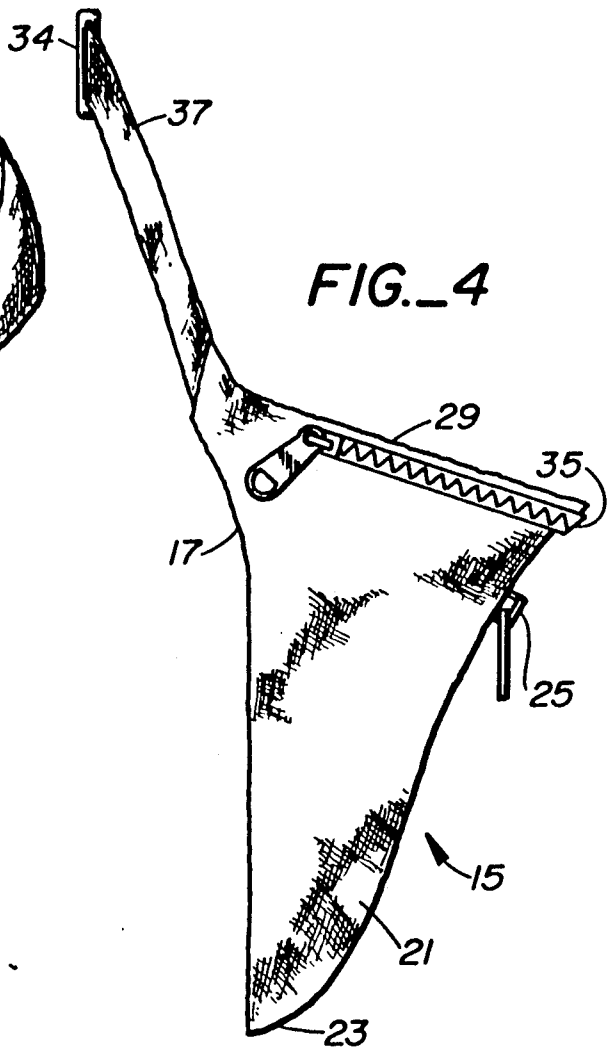
FIG. 4 is a side elevation thereof.
Figure 3:
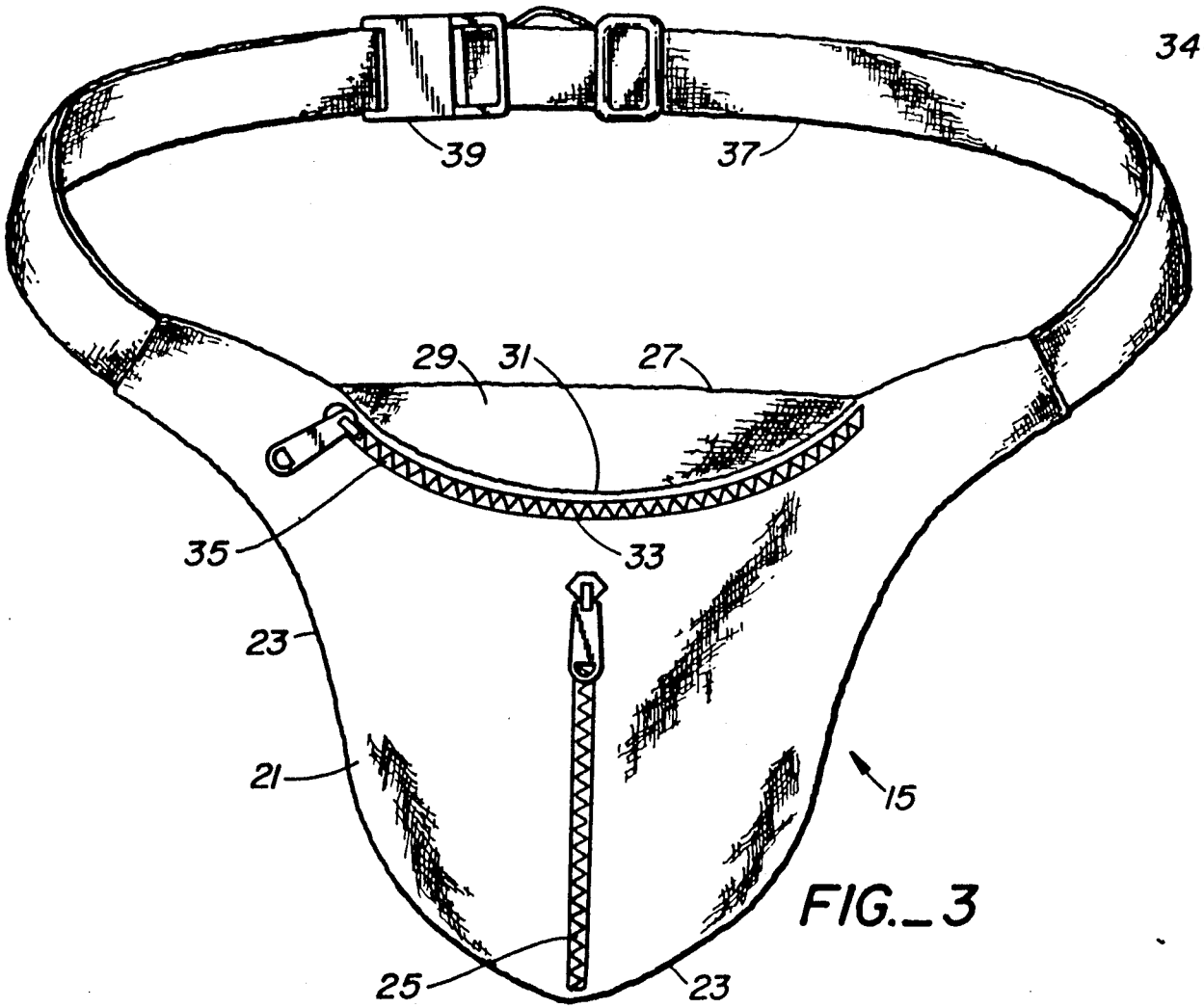
FIG. 3 is a front elevation thereof.

Reference is made to FIG. 2 wherein the flat rear panel portion 17 of the waist pack 15 is illustrated. It has a width equal to or less than the width of the snowboard 11 whereby it does not overhang the edges of the snowboard while the board is being ridden over or through the snow. Otherwise, possible damage and tearing could occur to the fabric of the pouch due to the very sharp ice edges that can form in frozen snow due to the melting and refreezing of old snow which occurs as a result of the day/night cycle.

The packs 15 are generally made of a water resistant woven nylon material, and in some very expensive designs they can be of full grain leather construction. Other materials such as Gore-Tex and rip-stop fabrics could also be utilized.

The rear panel 17 of the pack 15 has loop engagement strips 19 sewn or glued to the outside surface at peripheral locations therearound for securing the pack to a snowboard 11 by means of mating hook engagement strips (not shown) which are secured to the snowboard at pre-selected positions thereon whereby the pack can be located either at the front or closer to the front binding, as desired.

The hook and loop engagement strips are fabric pieces typically used as clothing closures and the loop strips 19 can be secured to the pack rear panel 17 by stitching or gluing. The hook strips can be secured to the snowboard 11 with adhesives. The loop engagement strips on the pack 15 are smooth or passive and do not engage other items when the pouch is detached from the snowboard. Additional hook and loop engagement strips in addition to the peripherally disposed ones can be positioned on the rear panel of the pack and the snowboard for increasing the security of the engagement of the pack to the snowboard, but the main securement strips are the peripheral ones which provide a barrier to snow penetrating between the board and pack and possibly wetting the contents of the pack on a warm day when the snow is wet.

A front pocket panel 21 is provided which is secured to the rear panel 17 of the pack 15 along the peripheral side and bottom edges 23 thereof to provide a compartment between the panels 17 & 21. The front panel has a zippered opening 25 therein disposed, in the preferred embodiment, in a vertical orientation whereby when it is zipped down, items can be placed inside the larger compartment of the pack between the flat rear panel and the front panel. The front panel 21 is bulged in the form of a pocket to provide the interior volume for the pack 15 by virtue of the top edge 27 of the front panel 21 being longer than the top edge of the rear panel 17.

Figure 5:
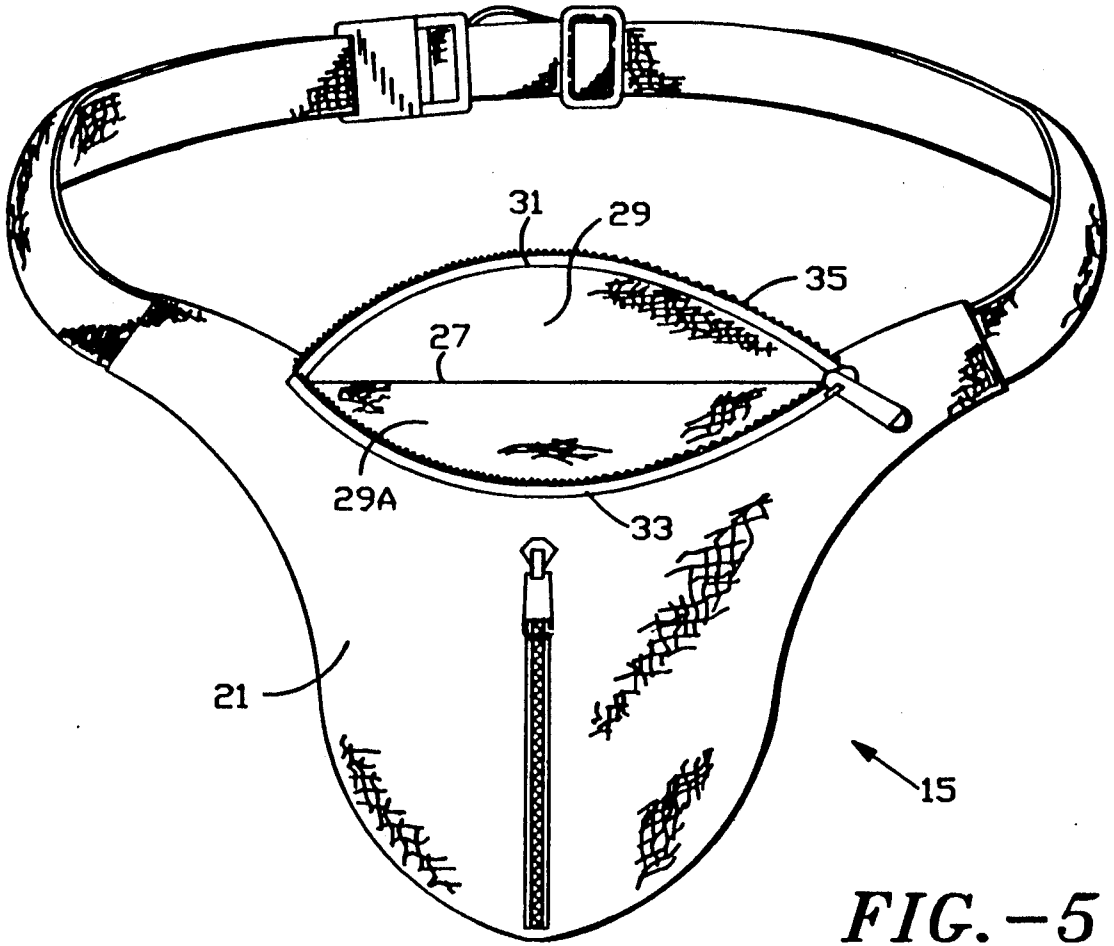
FIG. 5 is a front elevation with the top pocket zippered open.

Reference is made to FIG. 5. The pack 15 is completed by providing top covers to the pack in the form of a pair of semicircular top panels 29 and 29A secured to the top edges 27 of the rear 17 and front 21 panels with the flat edges of the semicircular panels both being secured to the straight upper edge 27 of the rear panel. This is generally a sewn permanent seam or connection. The rounded edge of the lower of the top panels is likewise secured to the upper edge of the front panel also by sewing, gluing, or other means which forms a permanent seam. The rounded edge 31 of the upper of the top panels is secured to the upper edge 33 of the front panel with a zippered connection 35 for at least a portion of the length thereof forming a pocket in the top of the pouch between the upper and lower top panel sections for keeping small items such as keys or other items that need to be readily located or separated from the other items in the pack.

A carrying strap 37 is provided which is secured to the pack 15 at the ends of the straight upper edge 27 of the rear panel. The strap includes a buckle 39 which is disposed mid-length of the strap whereby the strap is adjustable in length and can be detached into two separate free ends whereby the ends can be wrapped around the body of the wearer and then reattached at the buckle whereby the strap encircles the wearer's waist. The pouch can then be rotated around to the front of the wearer after the length has been adjusted and the buckle secured. When the pack is secured to the snowboard, the straps can be tucked into one of the zippered pockets or placed under the pack between the hook and loop strips.

Thus, it will be apparent from the foregoing description of the invention, in its preferred form, that it will fulfill all the objects and advantages attributable thereto. While it is illustrated and described in considerable detail herein, the invention is not to be limited to such details as have been set forth except as may be necessitated by the appended claims.

I claim:

1. A removable snowboard pack comprising a flat rear panel portion having peripheral side and bottom edges and a width equal to or less than the width of a snowboard, said rear panel having a generally straight upper edge and a rounded bottom edge and a rounded bottom edge, loop engagement strips disposed at peripheral locations around said rear panel on the side of said panel which will form the outside of said pack for securement of mating hook engagement strips secured to said snowboard at pre-selected positions thereon for removably securing the back panel of said pack to a snowboard, a front pocket panel secured to the rear panel along the peripheral side and bottom edges thereof, said front panel having a zippered opening therein and a straight upper edge of longer length than said rear panel upper edge, upper and lower semicircular top panels secured to the top edges of said rear and front panels with the straight edges of said semicircular panels being secured to the straight upper edge of the rear panel and the rounded edge of the lower of said top panels secured to the upper straight edge of said front panel, the rounded edge of the upper of said top panels being secured to the upper edge of said front panel with a zippered connection for at least a portion of its length, and a carrying strap extending from the ends of said straight upper edge of said rear panel.

2. The removable snowboard pouch of claim 1 wherein said carrying strap includes a buckle disposed mid-length thereof whereby the strap is adjustable and can be detached into two separate free ends secured to said pack.

* * * * *